US006793522B2

(12) United States Patent
Yamashita

(10) Patent No.: US 6,793,522 B2
(45) Date of Patent: Sep. 21, 2004

(54) CONNECTOR HAVING AN OPERABLE MEMBER

(75) Inventor: Kazunori Yamashita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/378,584

(22) Filed: Mar. 3, 2003

(65) Prior Publication Data

US 2003/0190836 A1 Oct. 9, 2003

(30) Foreign Application Priority Data

Apr. 3, 2002 (JP) ..... 2002-057731

(51) Int. Cl.[7] ..... H01R 3/00
(52) U.S. Cl. ..... 439/489; 439/352; 439/157
(58) Field of Search ..... 439/157, 155, 439/152, 153, 159, 160, 488, 489, 372, 352

(56) References Cited

U.S. PATENT DOCUMENTS

| | | | | |
|---|---|---|---|---|
| 5,330,411 A | | 7/1994 | Fujitani et al. | 439/157 |
| 5,928,010 A | * | 7/1999 | Katsuma et al. | 439/157 |
| 6,319,050 B1 | * | 11/2001 | Miyazaki et al. | 439/489 |
| 6,328,582 B1 | * | 12/2001 | Fukamachi | 439/157 |
| 2003/0166351 A1 | * | 9/2003 | Shinozaki et al. | 439/157 |

* cited by examiner

*Primary Examiner*—P. Austin Bradley
*Assistant Examiner*—Felix O. Figueroa
(74) *Attorney, Agent, or Firm*—Gerald E. Hespos; Anthony J. Casella

(57) ABSTRACT

A connector (1) has a lever (20) to facilitate connection with a mating connector (2). The lever (20) has a detector (30) normally held at a standby position. However, the detector (30) can be displaced to a detecting position when the lever (20) reaches a connection position, thereby detecting a properly connected state of the connectors (1, 2).

15 Claims, 13 Drawing Sheets

CONNECTOR HAVING AN OPERABLE MEMBER

BACKGROUND OF THE INVENTION

1. Field of the Invention

The invention relates to a connector having an operable member.

2. Description of the Related Art

U.S. Pat. No. 5,330,411 shows a connector with a rotatable lever. The lever is formed with a cam groove that is engageable with a cam pin of a mating connector. The two connectors can be engaged lightly to fit the cam pin into the entry of the cam groove. The lever then is rotated, and the cam action between the cam groove and the cam pin pulls the two connectors toward each other and into connection.

A considerable operation force is required to rotate the lever. Thus, an operator may end the rotation partway without completely rotating the lever to a proper connection position, and the connectors may be left partly connected.

Consideration has been given to providing a detector on the main body of the connector to detect proper operation of the lever. The detector stays at a standby position when the lever is mounted partly, but is displaced to a detecting position when the lever reaches a connection position. Thus, an operator can determine whether the lever has reached the connected state. Accordingly, the operator has to rotate the lever to the connecting position and then displace the detector to the detecting position. However, these operations cannot be performed quickly if the operable portion of the lever is spaced from the detector.

The present invention was developed in view of the above problem and an object thereof is to enable two connectors to be connected to a proper connection position with good operability.

SUMMARY OF THE INVENTION

The invention relates to a connector with a connector main body. The connector also has an operable member with arms that are movably supported on the connector main body. Each arm is formed with a cam means for engaging a mating cam means on a mating connector. The two connectors can be fit lightly together so that the cam means engages the mating cam means. The operable member then is moved from an initial position towards a connection position. As a result, a cam action is generated between the cam means and the mating cam means to pull the connectors together. A detector is mounted in the operable member and usually is held at a standby position. However, the detector can be displaced to a detecting position when the operable member reaches the connection position to detect a properly connected state of the two connectors.

The arms of the operable member preferably are bridged by an operable portion, and the operable member can be moved from the initial position to the connection position by holding the operable portion. The detector comprises a displacing portion for displacing the detector from the standby position to the detecting position when the operable member reaches the connection position. The displacing portion preferably is near the operable portion. Thus, an operator can displace the detector to the detecting position by holding the displacing portion near the operable portion, thereby presenting good operability.

The operable member preferably comprises a lever rotatably supported on the connector main body. The lever has an operable portion and two arms that project from opposite ends of the operable portion. The arms are supported rotatably on the connector main body. Each arm has a cam groove for engaging a corresponding cam pin of a mating connector. The two connectors are fit lightly together so that the cam pins enter the cam grooves. The lever then is rotated to generate a cam action between the cam grooves and the cam pins. Thus, the connectors are pulled toward each other and connected by the cam action. A detector is mounted in the lever. The detector normally is held at a standby position, but can be displaced to a detecting position to detect a properly connected state of the two connectors when the lever reaches the connection position. The detector comprises a displacing portion near the operable portion of the lever. The displacing portion is configured to displace the detector from the standby position to the detecting position. Displacement of the detector can proceed quickly after complete rotation of the lever because the displacing portion is near the operable portion of the lever, thereby presenting good operability.

Legs may project from the displacing portion of the detector. Each leg preferably has a lock, and the connector main body has lock receiving portions for receiving the locks. The locks and the lock receiving portions may engage to lock the operable member when the detector reaches the detecting position.

The lock receiving portions preferably are at side surfaces of the connector main body and correspond to the lock on each leg. Thus, stronger engagement can be realized as compared to a case where the lock receiving portion engages a lock only at one position.

An arcuate surface may be on each side surface of the connector main body and may be substantially concentric with the center of rotation of the lever. The lock is held substantially in sliding contact with the arcuate surface to hold the detector at the standby position as the lever is rotated.

The lock receiving portion may be a radially inwardly directed recess at an end of the arcuate surface.

The lever is at the connection position when the locks align with the lock receiving portions at the ends of the arcuate surfaces. Thus, the locks disengage from the arcuate surfaces and can be displaced to the detecting position when the lever reaches the connection position. The displacement by the displacing portion first becomes possible at this stage, and the locks are displaced into the lock receiving portions at the ends of the arcuate surfaces. Rotation of the lever is hindered when the locks are received by the lock receiving portions. Therefore, the lever is locked securely by the connector main body so as not to rotate.

The detector is mounted so that the legs are at the inner sides of the corresponding arms of the lever. Each arm has a long radially aligned engaging window. Each lock bulges out and fits into the engaging window from inside. Accordingly, the position of the detector can be judged easily merely by seeing the positions of the locks in the engaging windows. Thus, an operator can determine whether the detector is at the standby position or the detecting position.

The displacing portion preferably is at a rear side with respect to an operating direction of the operable member. Accordingly, the operator can rotate the lever by holding the displacing portion and displacing the detector to the detecting position when the lever reaches the connection position. As a result, rotation of the lever can be followed directly by the displacement of the detector without any interruption, thereby presenting good operation efficiency.

The arms of the lever may be coupled to each other by the detector. Thus, the legs are held in engagement with the arms, and the displacing portion bridges the arms to enable the operable member to be operated above the connector main body. In this embodiment, the displacing portion also serves as the operable portion. The width of the arms can be shortened along the rotating direction of the lever because the lever operable portion is not provided between the arms. As a result, the interference of the lever and the connector main body can be avoided at the initial and connection positions of the lever.

The detector is exposed to the outside by a window in at least one arm.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
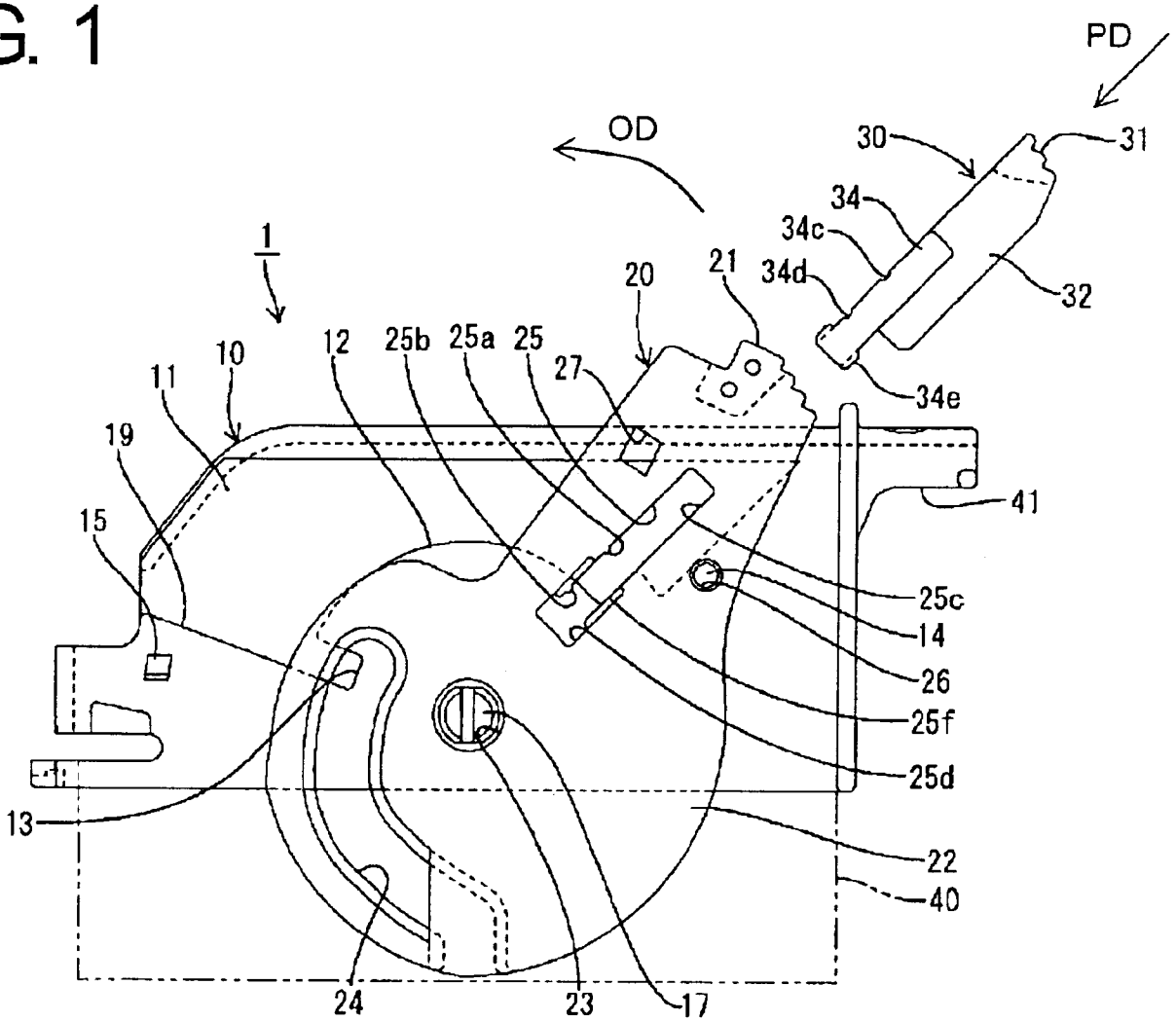
FIG. 1 is a side view of a lever-type connector according to a first embodiment of the present invention showing a state where a detecting member is separated from a lever.
Figure 2:
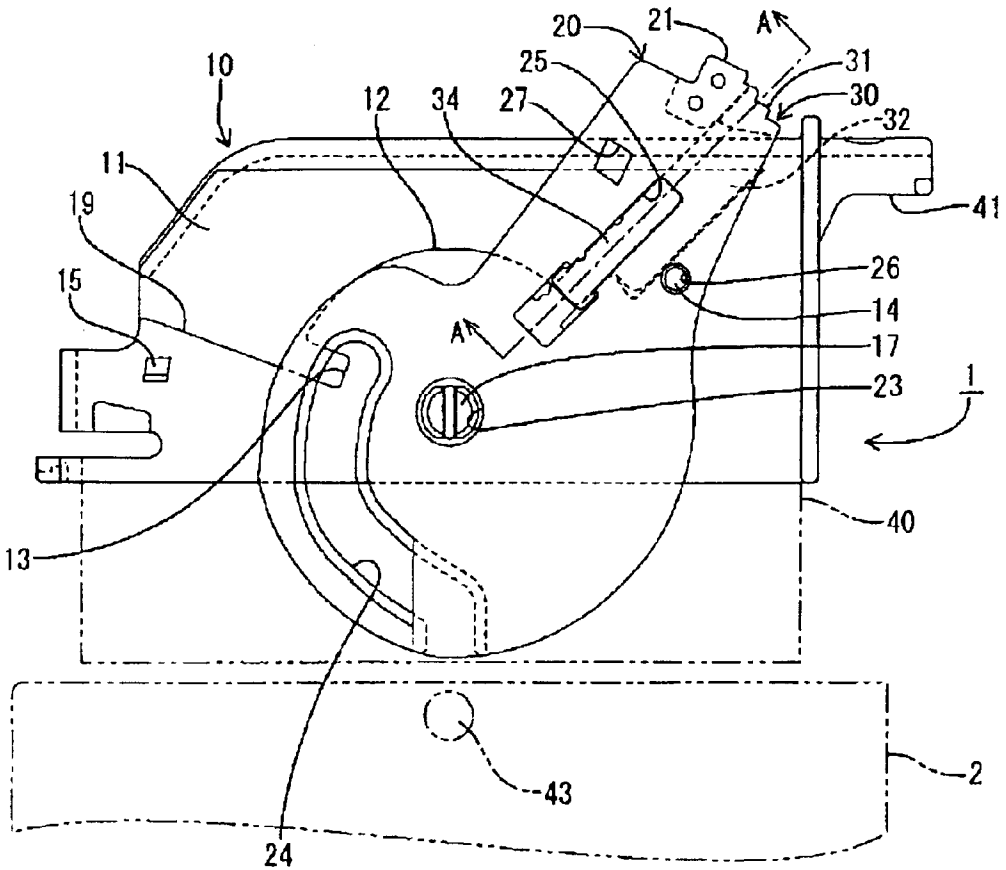
FIG. 2 is a side view showing the lever at an initial position.
Figure 3:
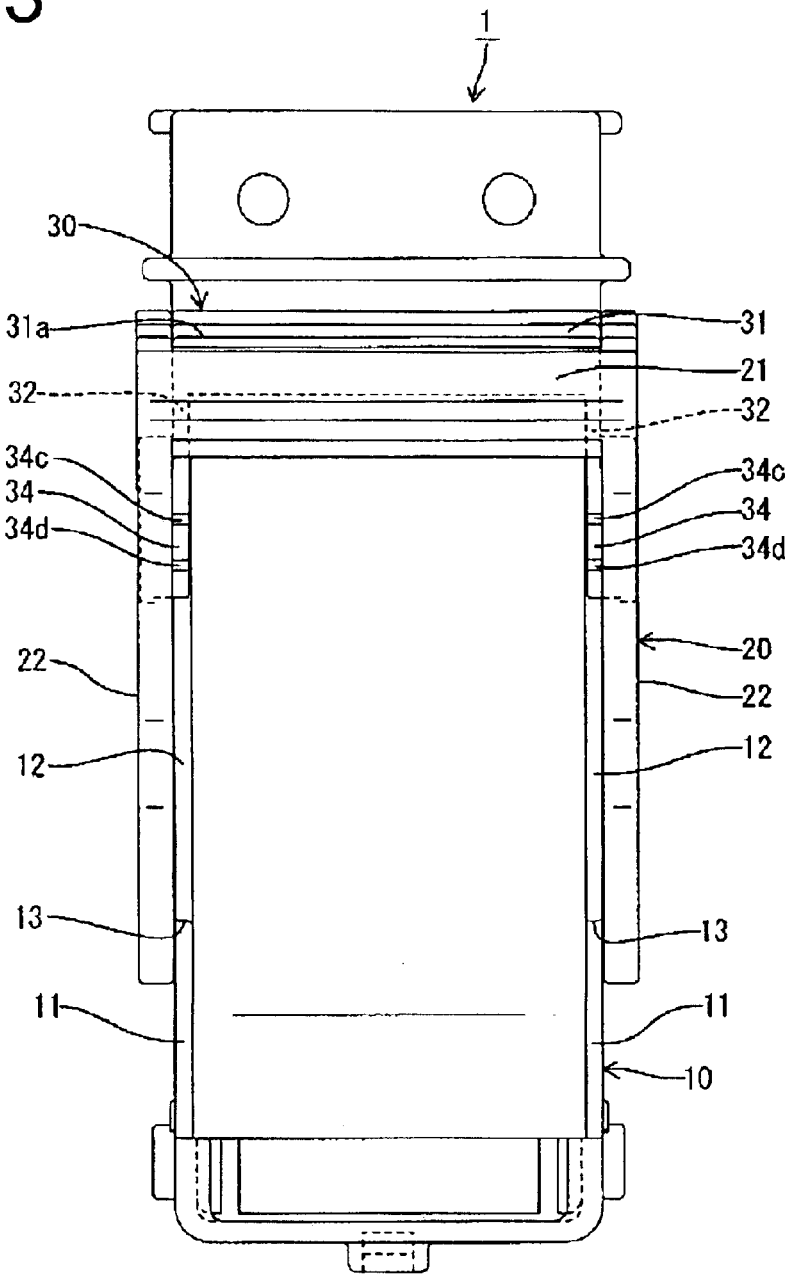
FIG. 3 is a plan view showing the lever at the initial position.
Figure 4:
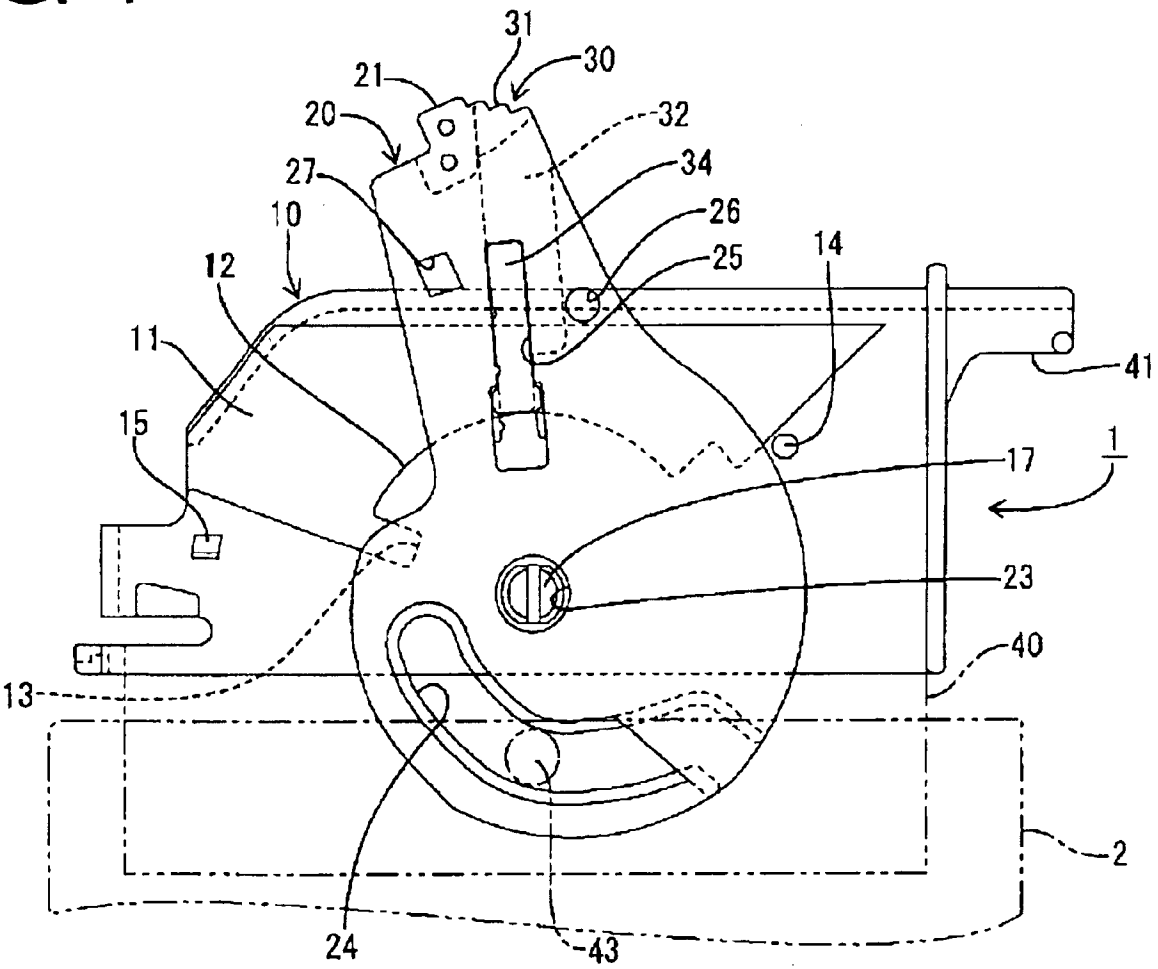
FIG. 4 is a side view showing an intermediate stage of rotation of the lever toward a connection position.
Figure 5:
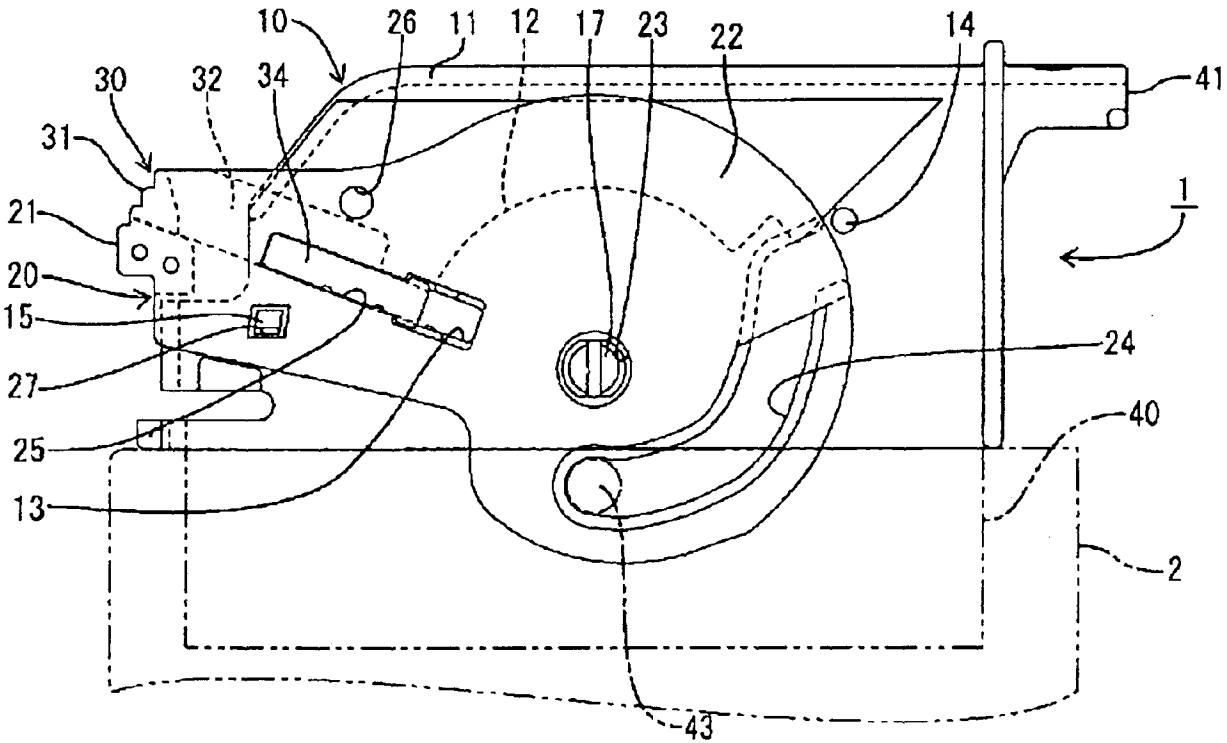
FIG. 5 is a side view showing the lever at the connection position.

A lever-type connector according to the invention is identified by the numeral 1 in FIGS. 1 to 6, and is configured for connection with a mating connector 2. The connector 1 has a connector main body 10 that includes a housing 40 and a wire cover 41 that can be mounted on an upper surface of the housing 40. A wire (not shown) is drawn out through the upper surface of the housing 40 and is bent backward. The bent wire then is drawn out backward from the main body 10. The mating connector 2 has two cam pins 43 projecting respectively from opposite side surfaces of the mating connector 2.

Opposite side walls 11 of the connector main body 10 have outwardly facing recesses Q. The recesses Q form convex cylindrically generated arcuate surfaces 12. A lock cavity 13 is formed at an end of each arcuate surface 12 and projects in along a radius of the arcuate surface 12. First and second locks 14 and 15 project out from the side walls 11 of the connector main body 10 at opposite circumferential ends of the recess Q and shafts 17 project out from the side walls 11 substantially at the center of the arcuate surface 12. A contact edge 19 defines a front boundary line of each recess Q. The contact edge 19 is substantially continuous with the lock cavity 13.

A lever 20 is supported rotatably on the connector 1 and the connector 1 can be connected with a mating connector 2 by operating the lever 20. The lever 20 has an operable portion 21 and two substantially plate-shaped arms 22 that project from the ends of the operable portion 21. The arms 22 have bearing holes 23 supported rotatably on the center shafts 17 of the connector main body 10 and cam groves 24 are spaced from the bearing holes 23. The lever 20 can be rotated from an initial position where entrances of the cam grooves 24 open down and a connection position (see FIG. 6) where the two connectors 1, 2 are connected.

Each arm 22 has an engaging window 25 in the form of a long hole that extends in the radial direction from the center of rotation of the lever 20. Each engaging window is formed with upper and lower protrusions 25*a*, 25*b*. Additionally, each engaging window 25 has a narrow engaging window 25*c* located at the radially outer side and a wide engaging window 25*d* located at the radially inner side. Two guide rails 25*f* extend along the inner edges (back side of the plane of FIG. 2) of the wide engaging window 25*d* from locations adjacent the narrow engaging window 25*c*. The upper protrusion 25*a* projects into the narrow window 25*c* near the wide window 25*d* and the lower protrusion 25*b* projects into the wide engaging window 25*d* and near the guide rail 25*f*.

Each arm 22 of the lever 20 is formed with a substantially round first locking hole 26 at a position behind the engaging window 25. The first locking projection 14 on the connector main body 10 fits into the first locking hole 26 when the lever 20 is at the initial position. Thus, the lever 20 can be locked at the initial position by the connector main body 10. Each arm 22 also has a substantially rectangular second locking hole 27 at a position before the engaging window 25. The second locking projection 15 on the connector main body 10 fits into the second locking hole 27 when the lever 20 is at the connection position. Thus, the lever 20 can be locked at the connection position on the connector main body 10.

The connector 1 further includes a unitarily formed substantially U-shaped detector 30. The detector 30 has a displacing portion 31 and legs 32 that project at right angles form opposite ends of the displacing portion 31. The displacing portion 31 is behind and near the operable portion 21 of the lever 20 and crosses above the connector main body 10. The legs 32 extend along the side surfaces of the connector main body 10. A stepped non-slip portion 31*a* is raised to the front on the upper surface of the displacing portion 31. Further, a lock 34 bulges out at the leading end of the respective leg 32 and fits into the corresponding engaging window 25 in the arm 22 of the lever 20 from the inside. Additionally, the lock 34 is dimensioned to fit in the locking cavity 13.

Each lock 34 of the detector 30 has an upper groove 34*c* and a lower groove 34*d* traversing the front surface thereof.

Figure 9A:
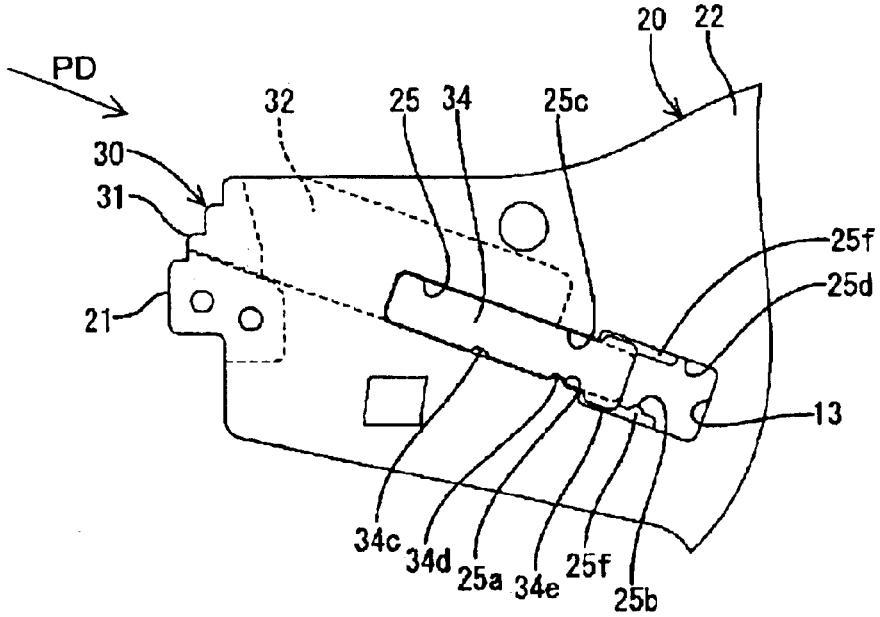
FIG. 9(A) is a fragmentary enlarged view showing the detector at the standby position in FIG. 2.
Figure 9B:
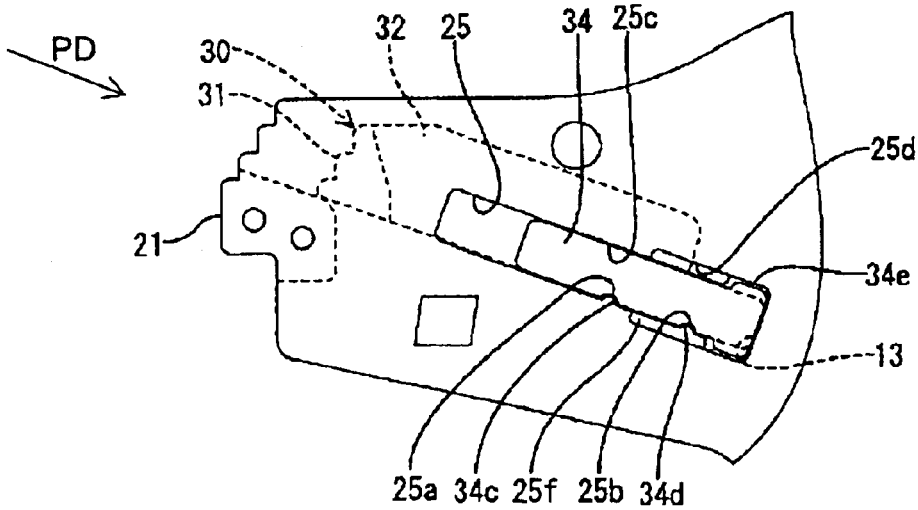
FIG. 9(B) is a fragmentary enlarged view showing the detector is at the detecting position in FIG. 6.
Figure 10:
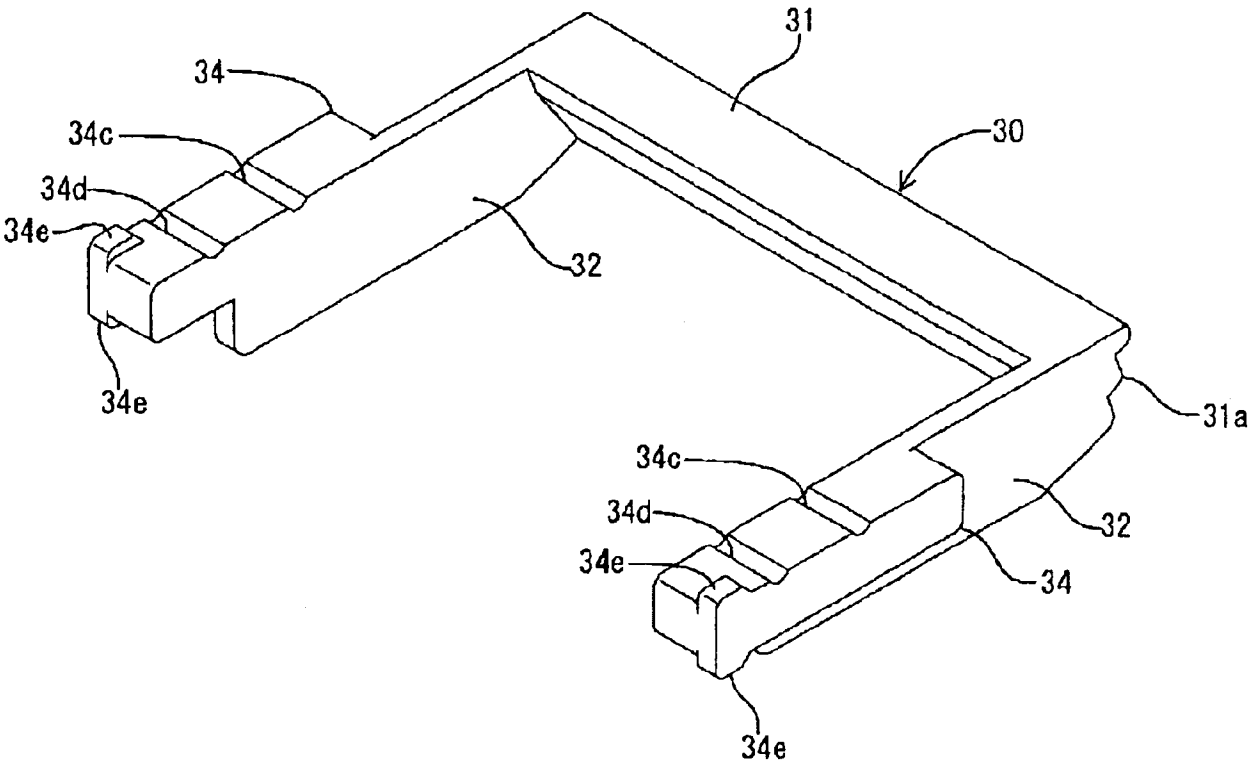
FIG. 10 is a perspective view of the detector.
Figure 11:
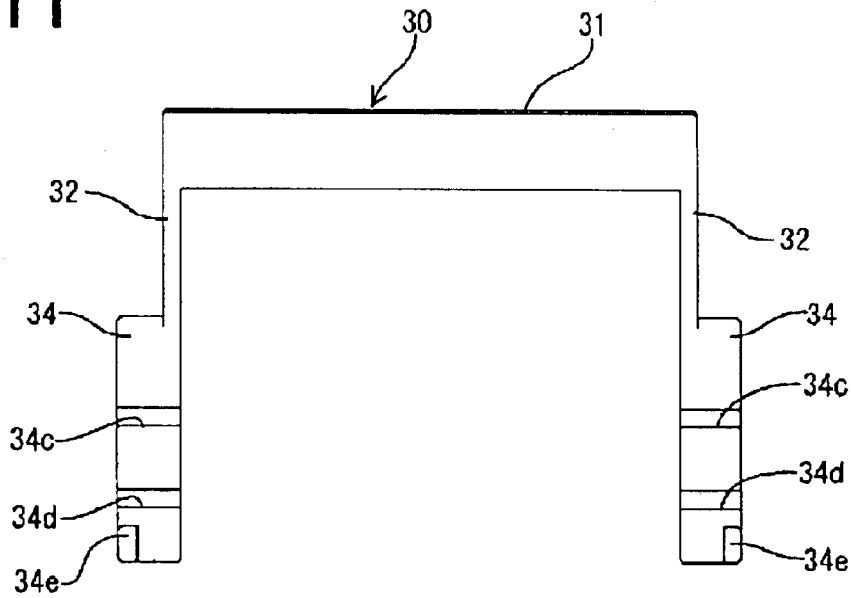
FIG. 11 is a front view of the detector.
Figure 12:
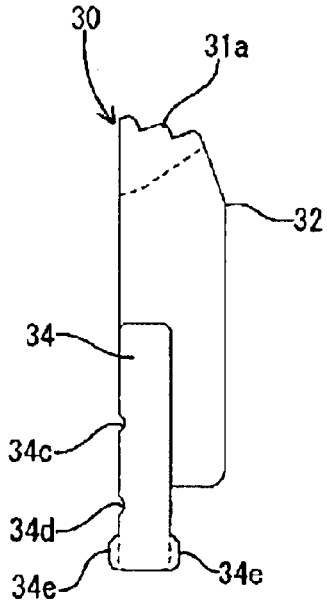
FIG. 12 is a side view of the detector.
Figure 13:
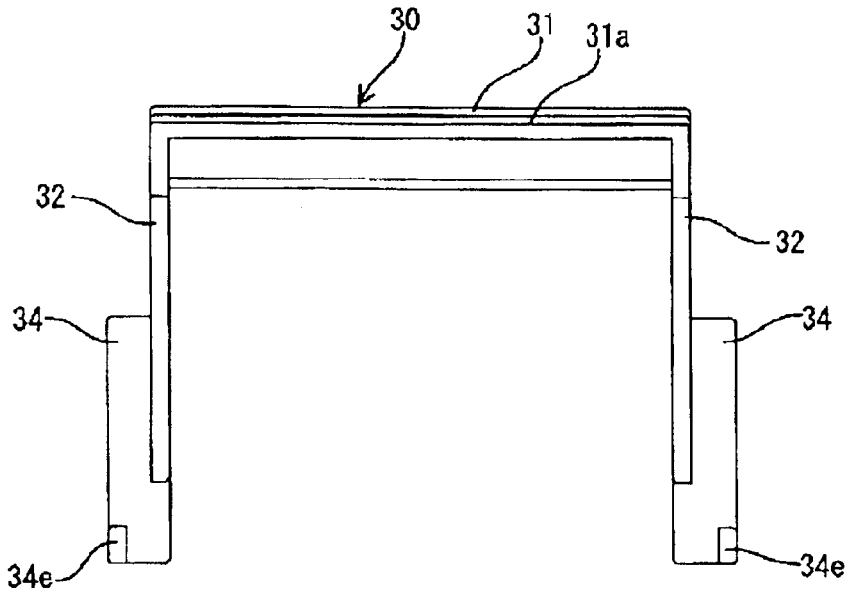
FIG. 13 is a rear view of the detector.

The upper protrusion 25*a* of the window 25 engages the lower groove 34*d* of the detector 30 when the detector 30 is at the standby position (see FIG. 9(A)). On the other hand, the upper protrusion 25*a* engages the upper groove 34*c* of the detector 30 and the lower protrusion 25*b* engages the lower groove 34*d* of the detector 30 when the detector 30 is at the detecting position (see FIG. 9(B)). In this way, the detector 30 is held either at the standby position or at the detecting position and is radially movable toward and away from the bearing hole 23 as an axis of rotation of the lever 20 along a pushing direction PD.

Projections 34*e* project in forward and backward directions at the bottom end of the lock 34. The inner sides of the projections 34*e* engage the outer sides of the guide rails 25*f* of the arm 22 and are guided by the guide rails 24*f* from the standby position to the detecting position. Thus, the detector 30 is prevented from disengagement from the lever 20.

The projection 34*e* of the lock 34 is in the wider engaging window 25*d* at a position near the narrower engaging window 25*c* when the detector 30 is at the standby position, but is near the rotation center shaft 17 when the detector 30 is at the detecting position. The displacement of the projection 34*e* can be seen from the outside so that an operator can determine whether the detector 30 is at the standby position or the detecting position.

The connector 1 can be fit lightly fitted to the mating connector 2 while the lever 20 is at the initial position. Thus, the cam pins 43 of the mating connector 2 fit into the entrances of the cam grooves 24. Subsequently, an operation force is exerted on the operable portion 21 of the lever 20 to cancel the locking between the first locking holes 26 and the first projections 14. As a result, the lever 20 can be rotated in the operating direction OD toward the connection position. The cam grooves 24 and the cam pins 43 display a cam action as the lever 20 is rotated toward the connection position, and the two connectors 1, 2 are pulled toward each other. The detector 30 is held at the standby position and the locks 34 of the detector 30 are held in sliding contact with the arcuate surfaces 12 during rotation of the lever 20. The front surfaces of the detector 30 press against the contact edges 19 and the second locking projections 15 fit into the second locking holes 27 when the lever 20 reaches the connection position. Additionally, the locks 34 align with the lock cavities 13. The displacing portion 31 then is pushed radially inward in the pushing direction PD. Thus, the locks 34 move from the standby position to the detecting position in the engaging windows 25 and enter the lock cavities 13. As a result, an operator can judge that the lever 20 has reached the connection position. Further, the relative positions of the locks 34 in the engaging windows 25 may be seen from outside to confirm easily whether the two connectors 1, 2 are connected properly.

The displacing portion 31 of the detector 30 is near the operable portion 21 of the lever 20. Thus, the operator can proceed quickly to the operation of displacing the detector 30 after completing the rotation of the lever 20, thereby presenting good operability. The displacing portion 31 is behind the lever 20 as seen in the operating direction OD of the lever 20. Therefore, the operator may rotate the lever 20 by holding the displacing portion 31 instead of the operable portion 21. As a result, an operator may proceed directly from rotating the lever 20 to displacing the detector 30, thereby presenting good operation efficiency. Thus, the operations can be performed without any interruption.

Figure 6:
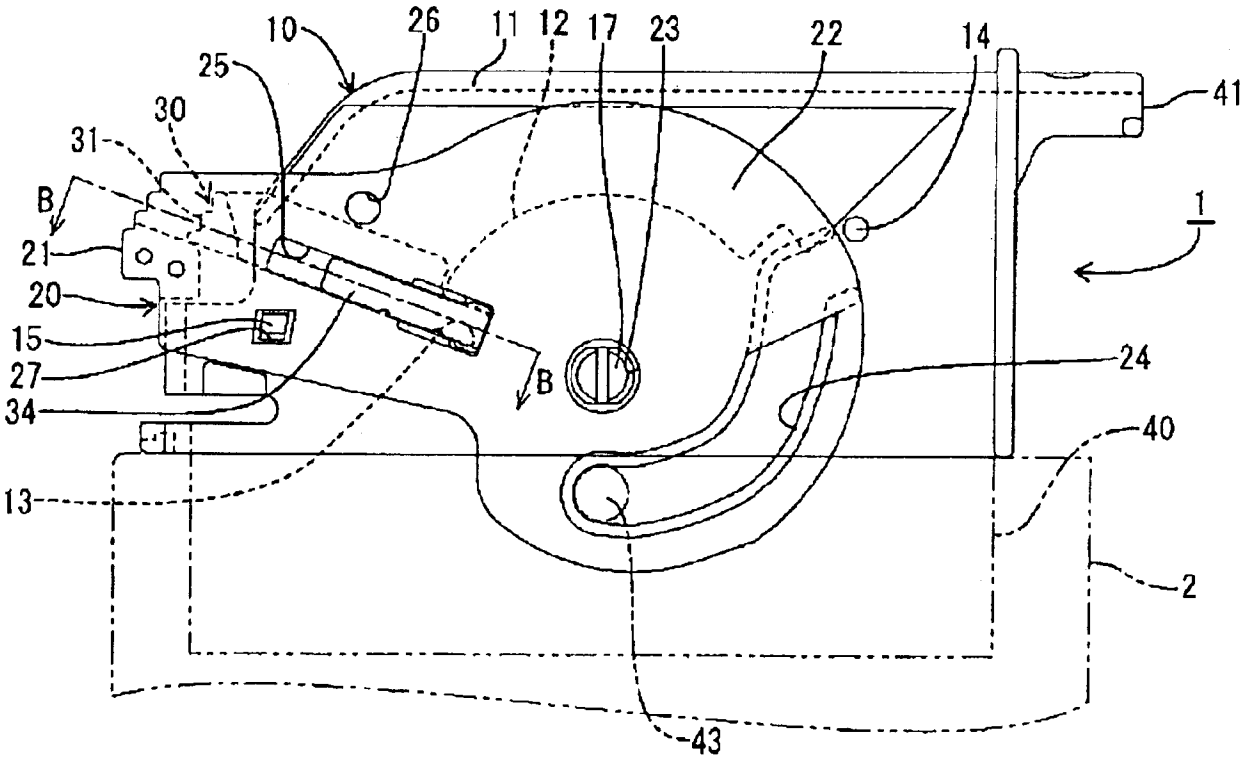
FIG. 6 is a side view showing the detector displaced to a detecting position.
Figure 7:
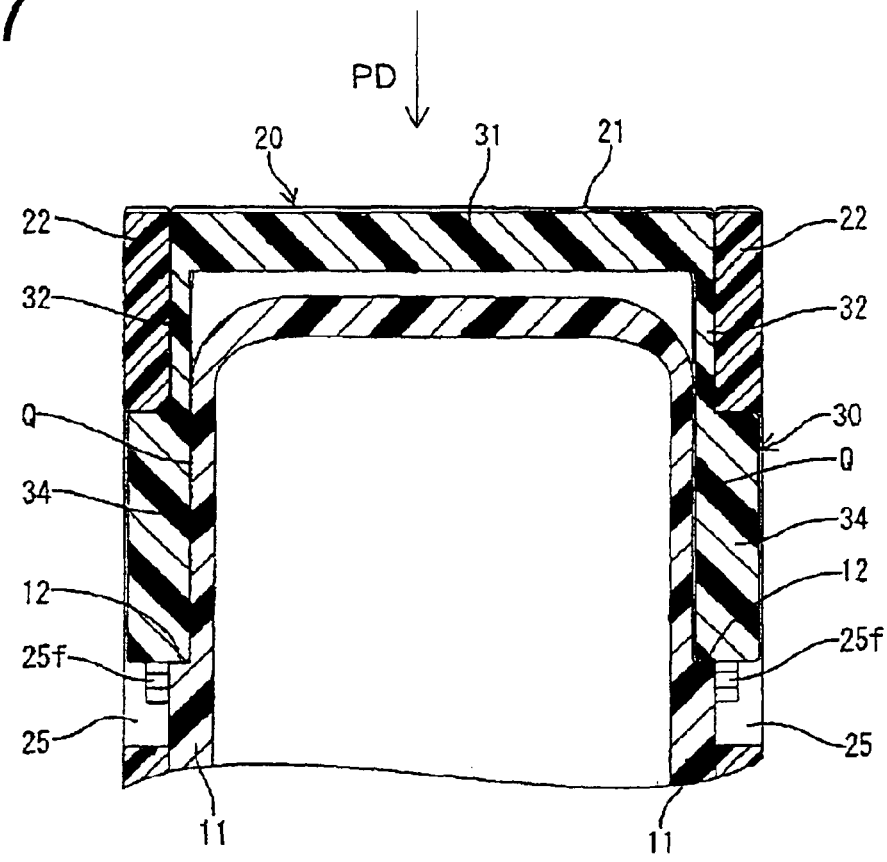
FIG. 7 is a sectional view along 7—7 of FIG. 2.
Figure 8:
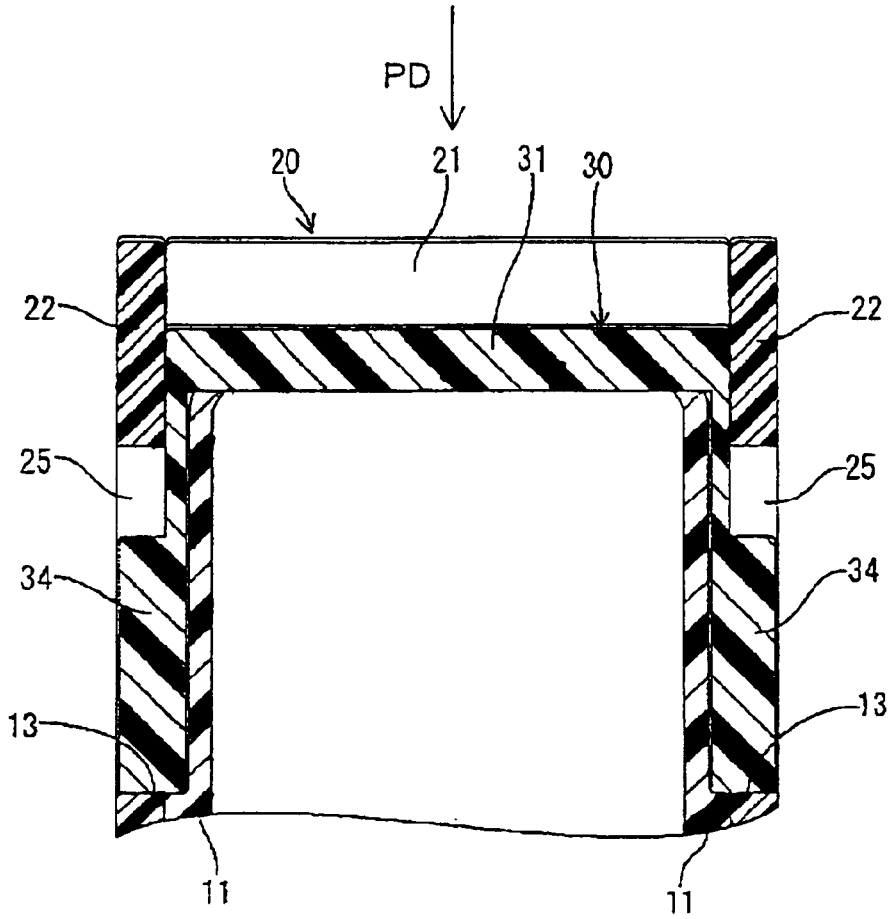
FIG. 8 is a sectional view along 8—8 of FIG. 6.

The lock cavities 13 are recessed radially inwardly along the pushing direction PD at the ends of the arcuate surfaces 12 and in positions corresponding to the connecting position (FIG. 6). Rotation of the lever 20 in a direction substantially normal to the pushing direction PD is hindered when the locks 34 are in the lock cavities 13. Thus, the lever 20 is locked and will not rotate with respect to the connector main body 10.

The lock cavities 13 are formed at each side surface of the connector main body 10 corresponding to the lock 34 on each of the legs 32. Thus, stronger engagement can be realized as compared to a case where a lock receiving portion is engaged with the lock 34 at only one position. As a result, the lever 20 can be locked securely.

Figure 14A:
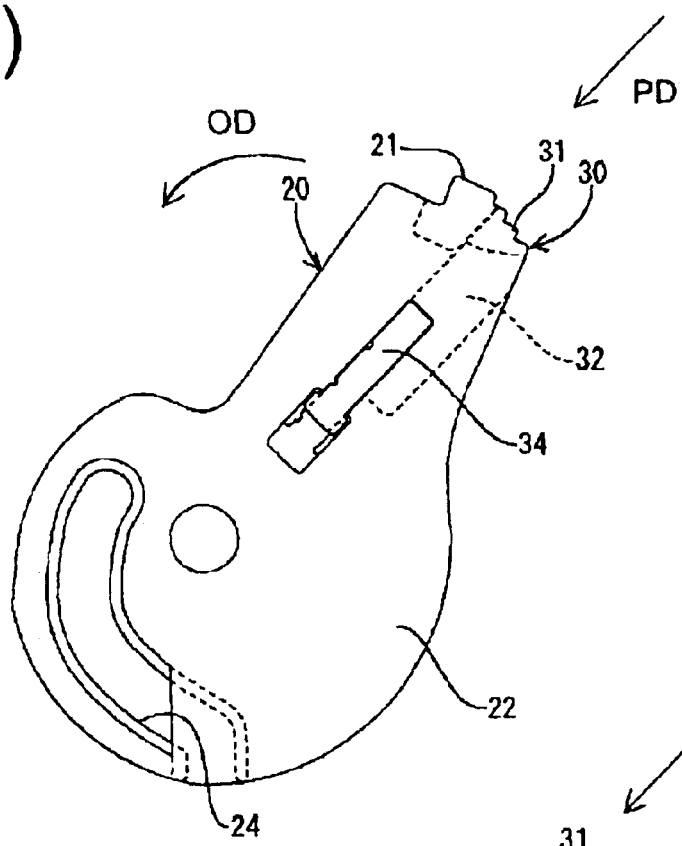
FIG. 14(A) is a side view of the lever having the detector mounted therein in the first embodiment.
Figure 14B:
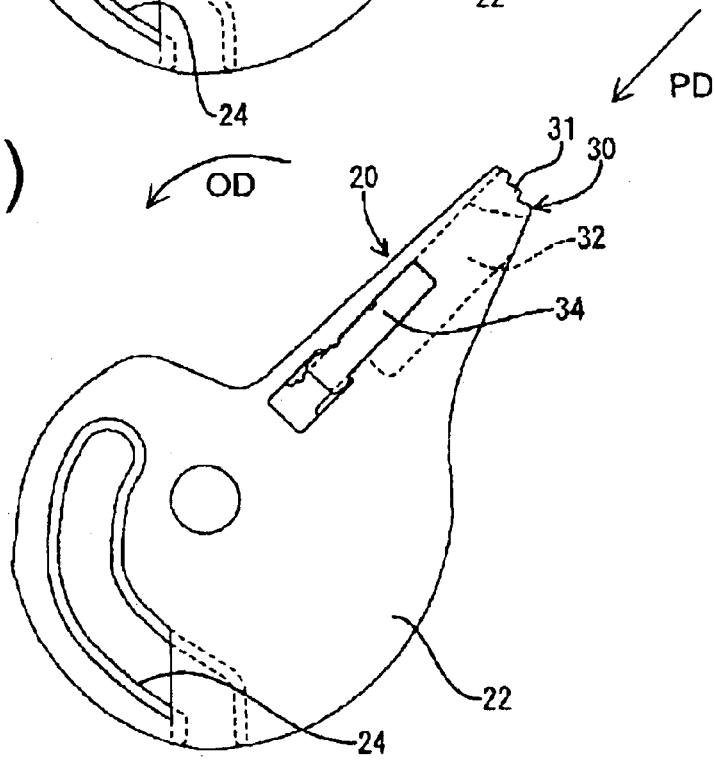
FIG. 14(B) is a side view of the lever having the detector mounted therein in a second embodiment.

A second embodiment of the invention is illustrated in FIG. 14(B). Elements of the second embodiment that are similar to the first embodiment are identified by the same reference numerals, but are not described again.

The second embodiment has a connector main body 10 and a lever 20 similar to the first embodiment. However, the lever 20 of the second embodiment has two separate, arms 22 rotatably supported on the opposite side walls of the connector main body 10. A mating connector 2 is provided with cam pins 43 that engage cam grooves 24 of the arms 22. The two connectors can be fit lightly together to engage cam pins 43 with cam grooves 24. The arms 22 then are rotated from an initial position to a connection position. As a result, a cam action is developed by the engagement of the cam grooves 24 and the cam pins 43 and the two connectors then are pulled toward each other and connected. The arms 22 are connected with each other by a unitarily formed detector 30 that normally is held at a standby position. However, the detector 30 can be displaced to a detecting position when the lever 20 reaches the connection position, thereby detecting a properly connected state of the two connectors. The detector 30 has a plate-shaped displacing portion 31 to displace the detector 30 from the standby position to the detecting position. Legs 32 project at right angles from opposite ends of the displacing portion 31 and engage the arms 22. The displacing portion 31 bridges the arms 22 and enables the lever 20 to be rotated above the connector main body 10. Thus, the displacing portion 31 also serves also as an operable portion to rotate the lever 20. Further, the width of each arm 22 along the operating direction OD of the lever 20 can be shorter (see FIG. 14(B)) than in the first embodiment (see FIG. 14(A)) since there is no operable portion between the arms 22. As a result, interference of the lever 20 and the connector main body 10 can be avoided at the initial and connection positions of the lever 20.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The displacing portion may be near the lever operable portion while defining a clearance to the lever operable portion without being in contact with the lever operable portion. Further, the displacing portion may be near the lever operable portion while being slightly stepped to the lever operable portion.

Instead of the engaging window, an engaging recess engageable with the lock may be formed at the inner side of each arm. The properly connected state of the two connectors can be detected by seeing the displacement of the displacing portion with respect to the lever.

The displacing portion of the detector may be before the lever operable portion.

The detector may not be U-shaped, but may take any desired shape.

Even though the invention has been described with reference to a lever rotatably provided on the connector main housing as the preferred operable member, it should be understood that other operable members such as substantially linearly slidable sliders may be used as operable members for displaying a cam action.

What is claimed is:

1. A connector, comprising:

a connector main body, an operable member having two arms supported on the connector main body and being movable between an initial position and a connection position, each arm being formed with a cam means for engaging a corresponding cam means of a mating connector, the cam means and the mating cam means being engaged when the operable member is at an initial position and the connector main body and the mating connector are connected lightly, and wherein the two connectors are pulled toward each other and connected by cam action of the cam means and the mating cam means when the operable member is moved from the initial position towards the connection position, and a detector mounted on the operable member, the detector being held normally at a standby position and permitted to be displaced to a detecting position to detect a properly connected state of the two connectors when the operable member reaches the connection position, the detector comprising a displacing portion to displace the detector from the standby position to the detecting position, the detector having legs integral with the displacing portion and projecting from opposite ends of the displacing portion, each leg having a lock and a lock cavity being formed in each side surface of the connector body at locations facing the legs, the lock cavities being dimensioned for receiving the locks.

2. The connector of claim 1, wherein the operable member a lever supported on the connector main body, the connectors connected with each other by rotating the lever.

3. The connector of claim 1, wherein when the detector reaches the detecting position, the locks and the lock cavities engage to lock the operable member so as not to move.

4. The connector of claim 1, wherein the arms are bridged by an operable portion.

5. The connector of claim 2, wherein the displacing portion is near the operable portion.

6. A connector comprising:

a connector main body, an operable member having two arms supported on the connector main body and being movable between an initial position and a connection position, each arm being formed with a cam means for engaging a corresponding cam means of a mating connector, the cam means and the mating cam means being engaged when the operable member is at an initial position and the connector main body and the mating connector are connected lightly, and wherein the two connectors are pulled toward each other and connected by cam action of the cam means and the mating cam means when the operable member is moved from the initial position towards the connection position, a detector mounted on the operable member, the detector being held normally at a standby position and permitted to be displaced to a detecting position to detect a properly connected state of the two connectors when the operable member reaches the connection position, the detector comprising a displacing portion adapted to displace the detector from the standby position to the detecting position, the detector having legs integral with the displacing portion and projecting from the opposite ends of the displacing portion, and wherein the operable member is a lever, an arcuate portion substantially concentric with the center of rotation of the lever is provided on each side surface of the connector main body substantially facing the leg, the lock being held substantially in sliding contact with the arcuate surface to hold the detector at the standby position as the lever is rotated.

7. The connector of claim 6, wherein each leg has a lock, and the connector main body being has a lock cavity in each side surface thereof facing the leg lock cavity being dimensioned for receiving the corresponding lock.

8. The connector of claim 6, wherein the lock cavity is formed at an end position of the arcuate surface where the lock is engaged with the lock cavity to locate the lever at the connection position and is recessed in radially inward direction to receive the lock.

9. The connector of claim 8, wherein:

the detector is mounted such that the legs thereof are at the inner sides of the corresponding arms of the lever, each arm being formed with an engaging window in the shape of a long hole extending substantially in radial direction from the center of rotation of the lever, and each lock bulges out to fit in the engaging window from inside.

10. The connector of claim 9, wherein the displacing portion is located at a rear side with respect to an operating direction of the lever toward the connection position.

11. The connector according of claim 9, wherein:

the arms are coupled to each other by the detector, the legs are held in engagement with the arms, and the displacing portion bridges the arms to enable the operable member to be operated above the connector main body.

12. The connector of claim 9, wherein the detector is exposed to the outside by a window in at least one of the arms.

13. A connector, comprising:

a connector main body having opposite sides and a lock cavity formed in each said side;

a lever having an operable portion and two arms projecting from opposite ends of the operable portion, the arms being supported on the sides of the connector main body for rotation between an initial position and a connection position, each arm being formed with a cam means for facilitating connection with a mating connector; and a detector having a displacing portion in proximity to the operable portion of the lever, legs projecting from the displacing portion and slidably engaged with arms of the lever, the detector being movably substantially radially inwardly relative to the lever and the connector main body from a standby position to a detecting position when the lever reaches the connection position, ends of the legs remote from the displacing portion defining locks for engaging in the lock cavities of the connector main body for locking the lever in the connection position when the detector is in the detecting position.

14. The connector of claim 13, wherein the sides of the connector main body each have an arcuate portion substantially concentric with a center of rotation of the lever, the lock being held substantially in sliding contact with the arcuate surface to hold the detector at the standby position as the lever is rotated.

15. The connector of claim 14, wherein the lock cavity is formed at an end of the arcuate surface.

* * * * *